US011826287B2

(12) United States Patent
Wilkie

(10) Patent No.: US 11,826,287 B2
(45) Date of Patent: Nov. 28, 2023

(54) TWO IDENTICAL ADJUSTABLE GRADUATED PILLOWS FOR SURGERY AND POST-SURGERY HEAD IMMOBILIZATION AND HEAD POSITIONING

(71) Applicant: Michelle Marie Wilkie, Los Angeles, CA (US)

(72) Inventor: Michelle Marie Wilkie, Los Angeles, CA (US)

( * ) Notice: Subject to any disclaimer, the term of this patent is extended or adjusted under 35 U.S.C. 154(b) by 46 days.

(21) Appl. No.: 17/207,006

(22) Filed: Mar. 19, 2021

(65) Prior Publication Data

US 2021/0290467 A1 Sep. 23, 2021

Related U.S. Application Data

(60) Provisional application No. 62/992,438, filed on Mar. 20, 2020.

(51) Int. Cl.
*A61G 13/12* (2006.01)
*A47G 9/10* (2006.01)

(52) U.S. Cl.
CPC ..... *A61G 13/121* (2013.01); *A47G 9/1081* (2013.01); *A47G 2009/1018* (2013.01)

(58) Field of Classification Search
CPC ..... A47G 9/10; A47G 9/1054; A47G 9/1072; A47G 9/1081; A47G 2009/1018; A61G 13/121
See application file for complete search history.

(56) References Cited

U.S. PATENT DOCUMENTS

| | | | | |
|---|---|---|---|---|
| 1,890,358 | A | 12/1932 | Barcalo | |
| 3,775,785 | A | 12/1973 | Mittendorf | |
| 3,897,777 | A | 8/1975 | Morrison | |
| 4,031,578 | A * | 6/1977 | Sweeney | B60N 2/882 5/426 |
| 4,297,994 | A | 11/1981 | Bashaw | |
| 4,528,981 | A * | 7/1985 | Behar | A61F 5/055 5/637 |
| 4,710,099 | A | 12/1987 | Matsuura | |
| 4,710,991 | A | 12/1987 | Wilmore et al. | |
| 4,754,511 | A * | 7/1988 | Sargent | A47C 20/025 5/655.4 |
| 4,850,068 | A | 7/1989 | Walpin et al. | |
| 4,853,994 | A | 8/1989 | Ekstein | |
| 4,905,712 | A * | 3/1990 | Bowlin | A61F 5/05883 128/870 |
| 5,007,122 | A | 4/1991 | Daughdrill | |
| 5,012,539 | A | 5/1991 | Grigg | |
| 5,044,026 | A * | 9/1991 | Matthews | A47G 9/1054 5/644 |
| 5,146,641 | A * | 9/1992 | Zwickey | A47G 9/1009 5/628 |

(Continued)

*Primary Examiner* — David R Hare
*Assistant Examiner* — George Sun
(74) *Attorney, Agent, or Firm* — Nolan Heimann LLP; Adam Diament

(57) ABSTRACT

Two pillows 12-12 and 112-112 are joined and separated by cords 18 or a strap 118 to enable surgical and post-surgical immobilization and positioning of a user's head or neck. This protects movement of the patient during surgery or thereafter as an aid to the performing surgeon(s) and any post-surgical problems, such as damage or disturbance to stitching.

8 Claims, 9 Drawing Sheets

(56) References Cited

U.S. PATENT DOCUMENTS

| | | | | |
|---|---|---|---|---|
| 5,163,195 | A | 11/1992 | Hill | |
| 5,265,625 | A | 11/1993 | Bodman | |
| 5,305,754 | A | 4/1994 | Honeywell et al. | |
| 5,657,766 | A | 8/1997 | Durham | |
| 5,661,862 | A | 9/1997 | Ryndak | |
| 6,073,288 | A | 6/2000 | Berenstein | |
| 6,182,313 | B1 * | 2/2001 | Eschenbach | A47G 9/1009 5/639 |
| 6,226,818 | B1 | 5/2001 | Rudick | |
| 6,289,538 | B1 | 9/2001 | Fidge | |
| 6,886,201 | B1 | 5/2005 | Weiss-Lohrei | |
| 7,017,213 | B2 | 3/2006 | Chisari | |
| 7,089,615 | B1 | 8/2006 | Parimuha | |
| 7,810,192 | B2 | 10/2010 | Fujita et al. | |
| 7,975,336 | B1 * | 7/2011 | Perry | A47C 27/086 5/636 |
| 9,375,105 | B2 | 6/2016 | Thomson | |
| 9,414,698 | B2 | 8/2016 | Sheeler-Johnson | |
| 10,022,001 | B1 * | 7/2018 | Hawkins | A47G 9/1027 |
| 10,085,575 | B2 | 10/2018 | Vogel | |
| 10,251,808 | B1 * | 4/2019 | Theis | A47C 15/008 |
| 10,264,899 | B2 | 4/2019 | Biebl | |
| 2001/0047549 | A1 | 12/2001 | Ulert et al. | |
| 2003/0041380 | A1 * | 3/2003 | Hanley | A47C 20/027 5/640 |
| 2003/0182725 | A1 | 10/2003 | Baik | |
| 2008/0282474 | A1 * | 11/2008 | Hsin | A47G 9/10 5/636 |
| 2009/0101156 | A1 | 4/2009 | Rugfelt | |
| 2012/0084923 | A1 * | 4/2012 | Sveinsdottir | A47G 9/10 5/640 |
| 2015/0128348 | A1 | 5/2015 | Gottlieb | |
| 2017/0112302 | A1 * | 4/2017 | Taurins | A47G 9/1054 |
| 2018/0110645 | A1 | 4/2018 | Allen | |
| 2018/0168356 | A1 * | 6/2018 | Porowski | A47G 9/1081 |
| 2018/0310735 | A1 | 11/2018 | Racine | |
| 2018/0368593 | A1 * | 12/2018 | Bourgeois | A47G 9/1009 |
| 2019/0208935 | A1 | 7/2019 | Gao | |
| 2019/0254435 | A1 * | 8/2019 | Neu | A47C 7/383 |

* cited by examiner

FIG. 9
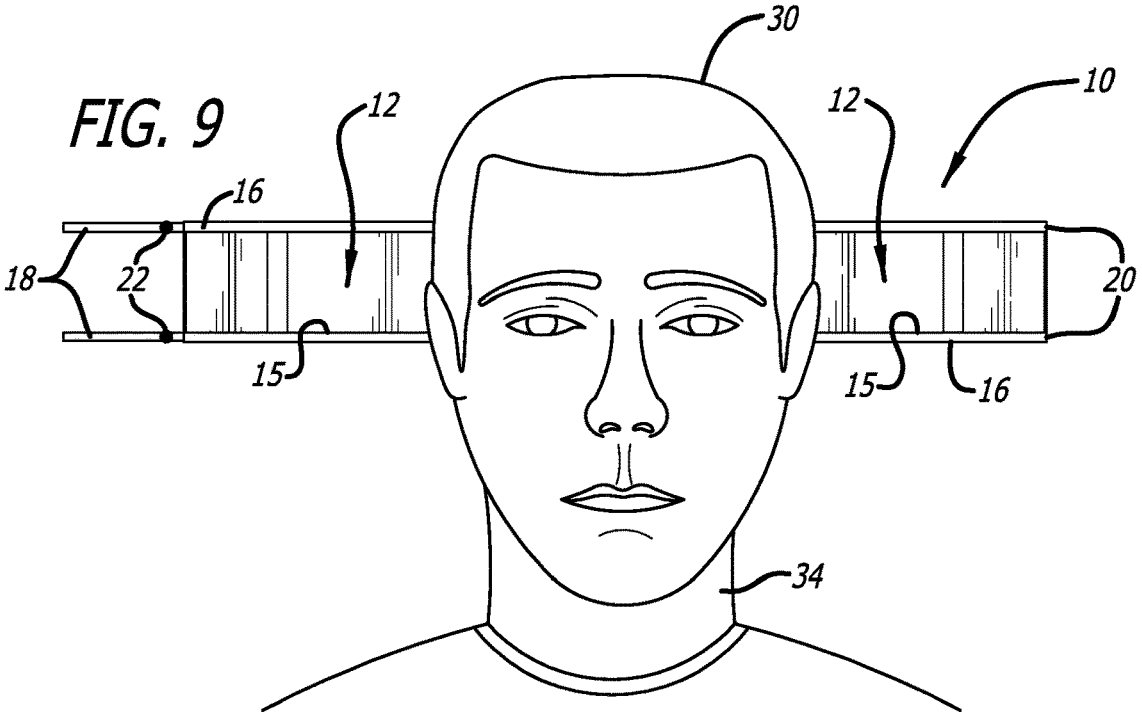
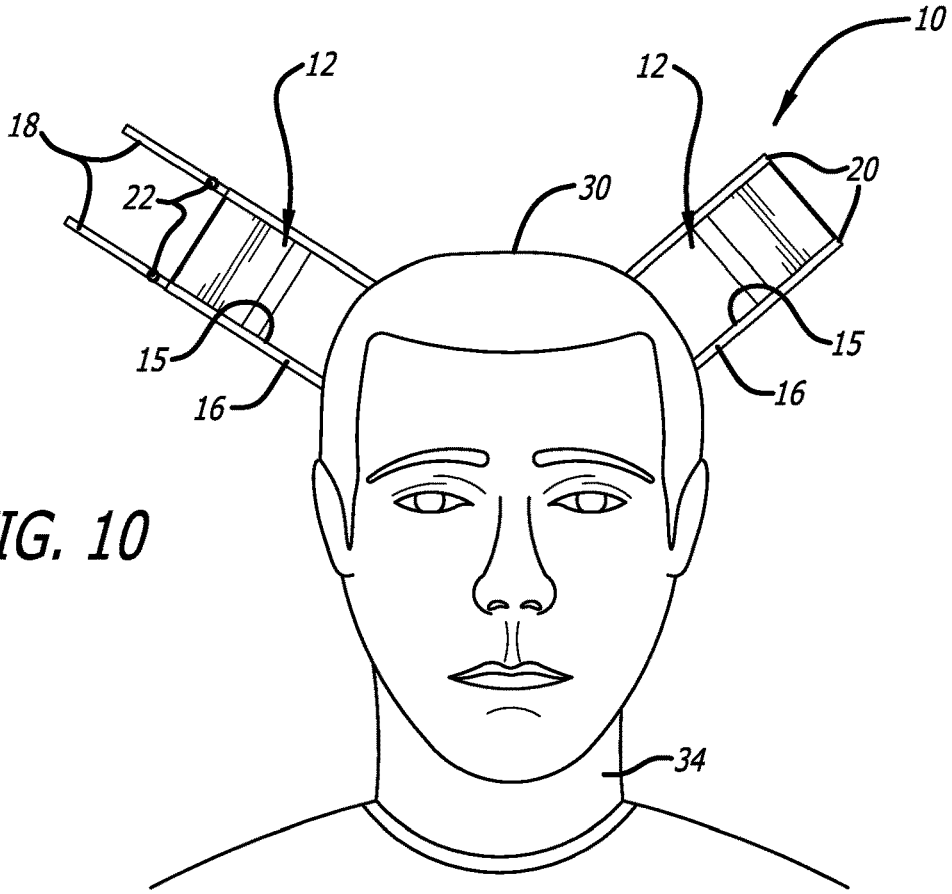
FIG. 10

FIG. 11
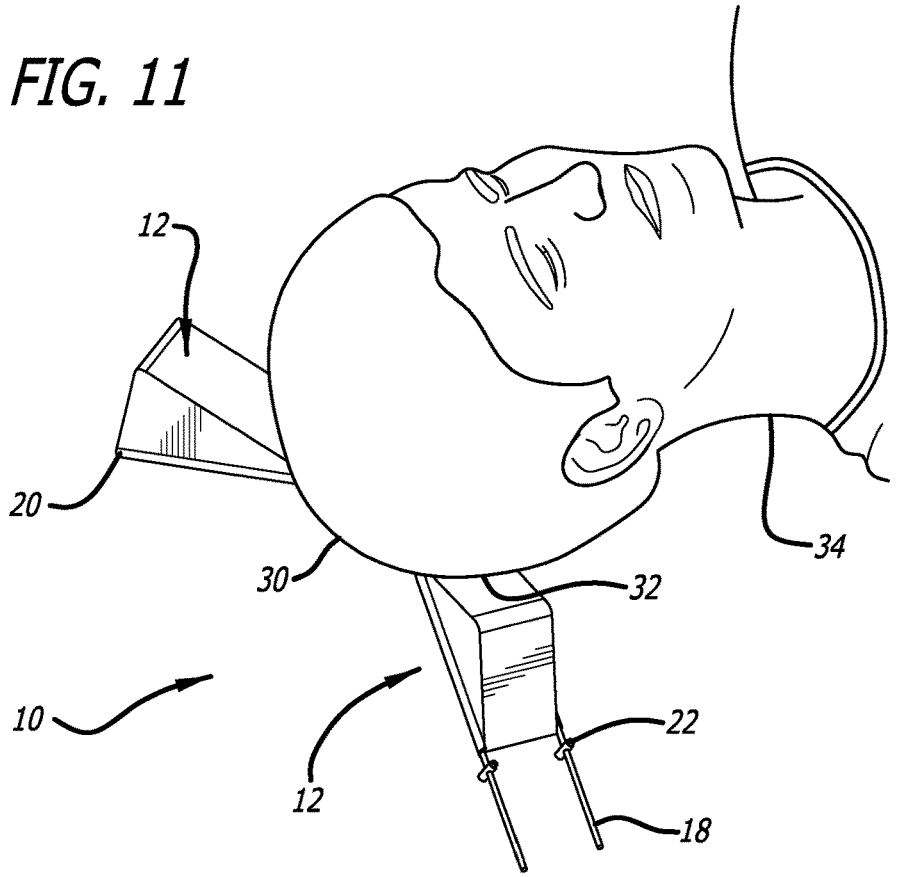
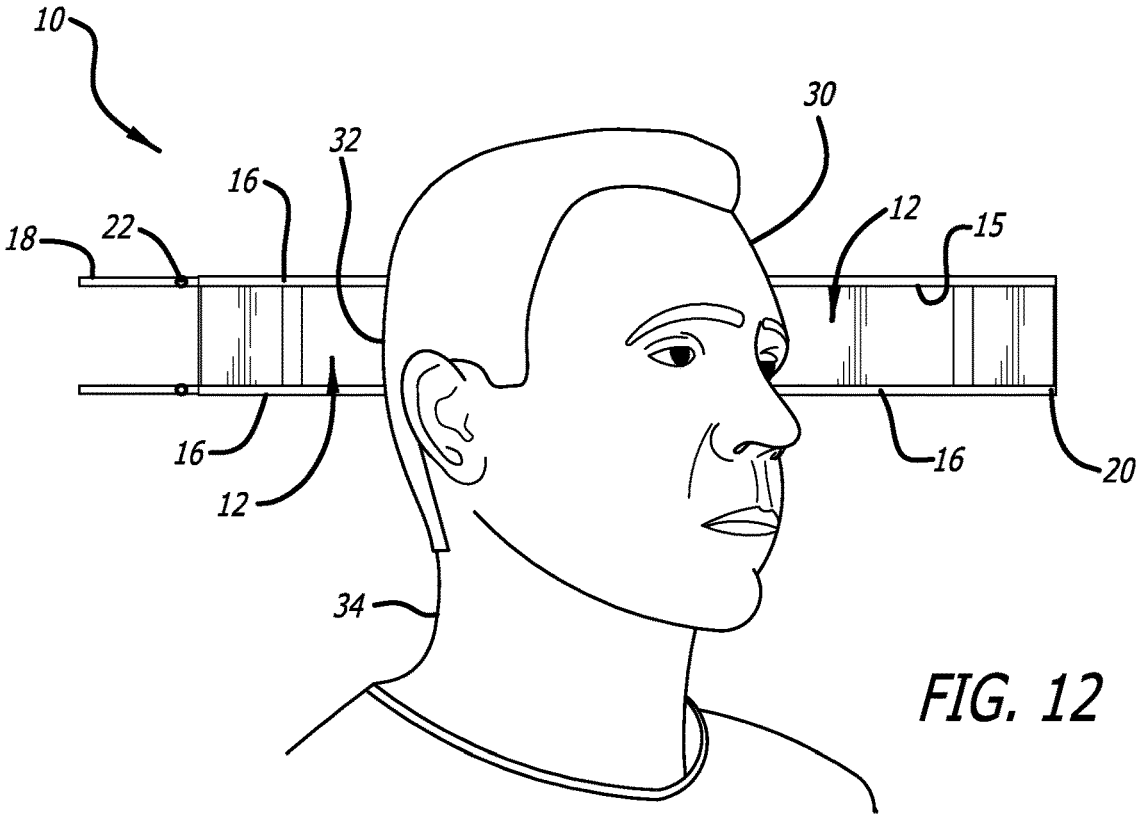
FIG. 12

FIG. 15
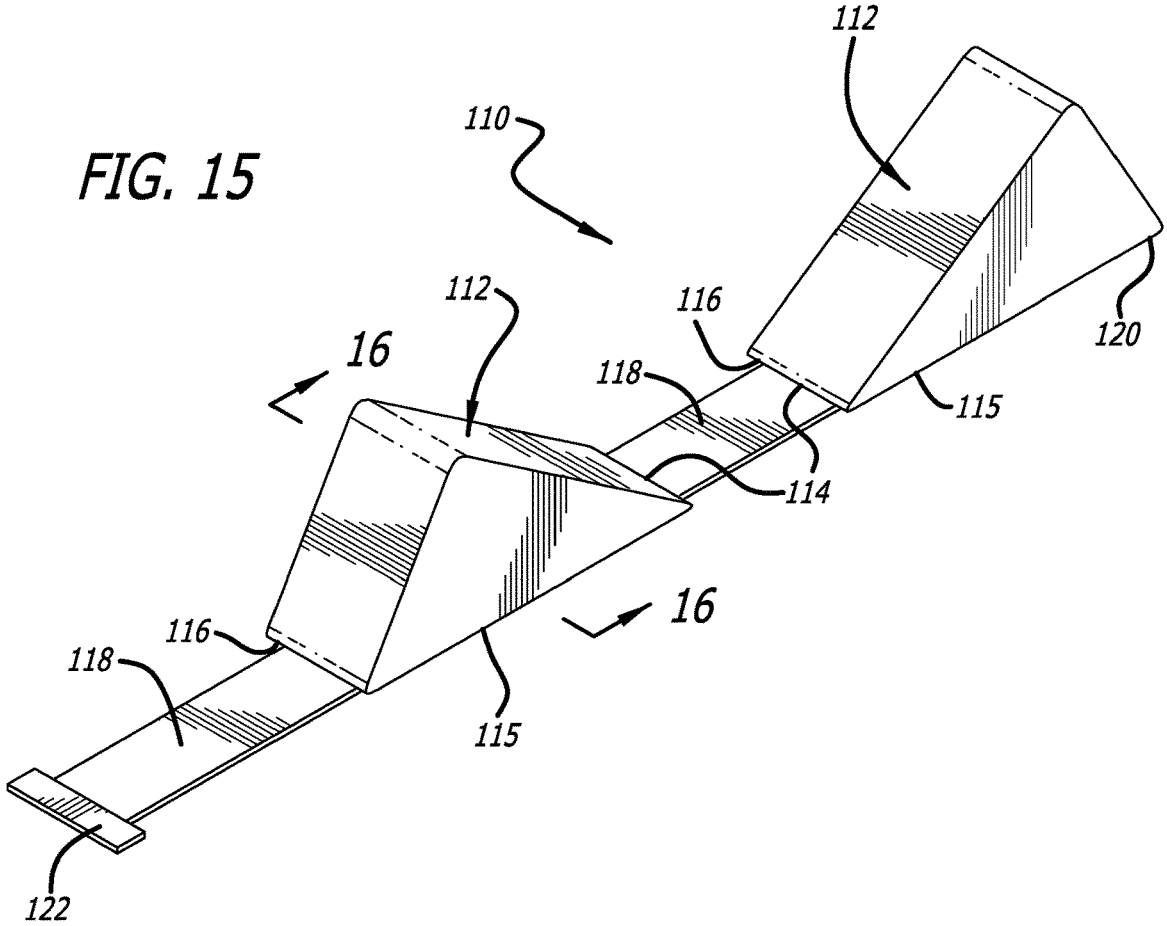
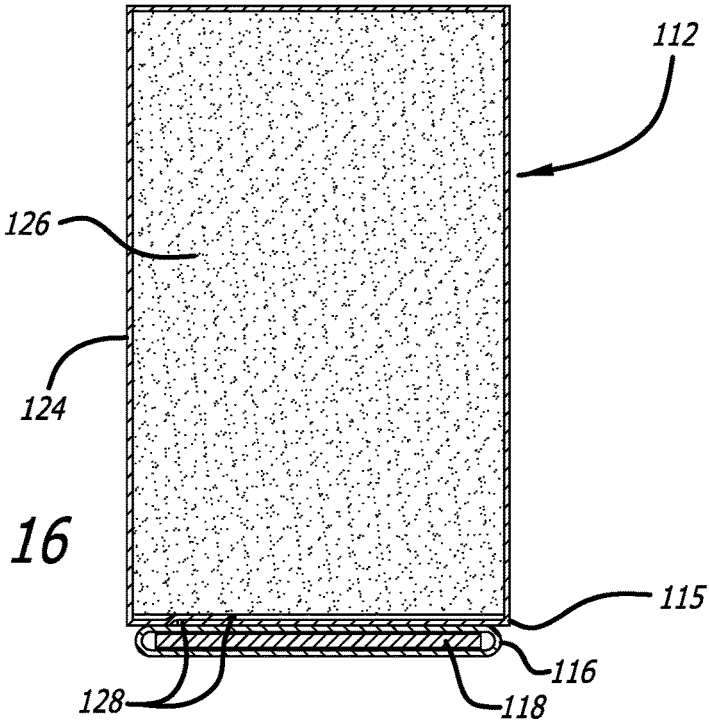
FIG. 16

TWO IDENTICAL ADJUSTABLE GRADUATED PILLOWS FOR SURGERY AND POST-SURGERY HEAD IMMOBILIZATION AND HEAD POSITIONING

CROSS-REFERENCE TO RELATED APPLICATION

This application claims the benefit of U.S. Provisional Application No. 62/992,438 filed 20 Mar. 2020.

REFERENCE REGARDING FEDERAL SPONSORSHIP OR DEVELOPMENT

Not Applicable

REFERENCE TO SEQUENCE LISTING OR MICROFICHE APPENDIX

Not Applicable

BACKGROUND OF THE INVENTION

1. Field of the Invention

The present invention relates to head and neck restraint pillows and, in particular, to improvements in such devices that enable surgical head immobilization, post-surgical head immobilization, and sleep-wrinkle prevention head immobilization.

2. Description of Related Art and Other Considerations

After surgery of the head and face areas, movement of the head can break open stitches inside and outside the surgery site or displace implants, fat grafting, or cause swelling to pool, causing internal bleeding which can be detrimental to the healing process and produce a poor surgery result. While there are many prior art pillow devices, which are devised to support the head and neck, they lack the necessary immobilization and positioning needed during surgery and thereafter. One group provides a strap over the top of the head or around the forehead; they defeats access during some surgical procedures or could interfere with healing of stitches or overly sensitized nerves as a result from the surgical procedure. For example, these and other patents do not serve the purpose of immobilizing the head and providing access to perform many surgeries such as neurosurgery in which the top of the cranium must be removed, face lift surgery, ear surgery, any surgery of the forehead, etc. Respectively, these same areas must remain unencumbered for protection of stitches and comfort of patient in post-op care. Some pillow devices which use straps around the forehead or the top of the head would prevent a sterile cloth to be placed over the device for optimum surgical sterilization. Some pillow devices employ VELCRO® Brand straps; these tangle hair and is abrasive to the skin.

SUMMARY OF THE INVENTION

These and other problems are successfully addressed and overcome by the present invention and several advantages are derived therefrom. Such advantages include surgical head immobilization, post-surgical head immobilization, head stabilizing positioning and repositioning, and sleep-wrinkle prevention head immobilization and head-stable positioning, all with minimal surface contact. Accordingly, the head is prevented not only from moving side-to-side during sleep after surgery but also during surgery.

Thus, the device's use is just as much for use in surgical procedures as for post-surgery care sleep comfort. The present invention is set apart from the prior art devices as not just for what it has, but for what it does not have as its streamlined functional design. Its further purpose is to provide the greatest access to one's head, neck and face with the least amount of contact thereto. It is adjustable and capable of being positioned on different places areas of the parietal and the occipital area of the head, of providing a variety of surgical access and likewise post-op isolation of surgical site. Also, the greatest comfort option for the anti-wrinkle sleep purpose is provided. It is created to be a compliment in a multitude of surgeries as well as post-op care. Adjustment is available for different turning angles for surgical access, for post-op care to isolate the traumatized area, and for comfort for stable anti-wrinkle prevention. Improvements include head-turning angle options while still keeping the side of the face from smashing into the pillow. VELCRO® Brand straps are avoided. Pillow devices of the single strap version with no buckle or toggle hold with merely the friction of the material and is usable for surgeries or situations in which quick and easy adjustment must be made instantly. The double strap with a toggle version is meant as a suggestion for the surgeon for surgical procedures in which there is no adjustment needed and the doctor desires to unequivocally eliminate the possibility that the support pillows slide.

Other aims and advantages, as well as a more complete understanding of the present invention, will appear from the following explanation of exemplary embodiments and the accompanying drawings thereof.

BRIEF DESCRIPTION OF THE DRAWINGS

FIG. 9-14 depict the pillows supporting the user at the back of the user's head;

FIG. 15 is a perspective view of a second embodiment of the present invention shown as a pillow with a single stray; and FIG. 16 is a cross-sectional view of the present invention taken along lines 16-16 of FIG. 15.

DETAILED DESCRIPTION OF THE PREFERRED EMBODIMENTS

Figure 1:
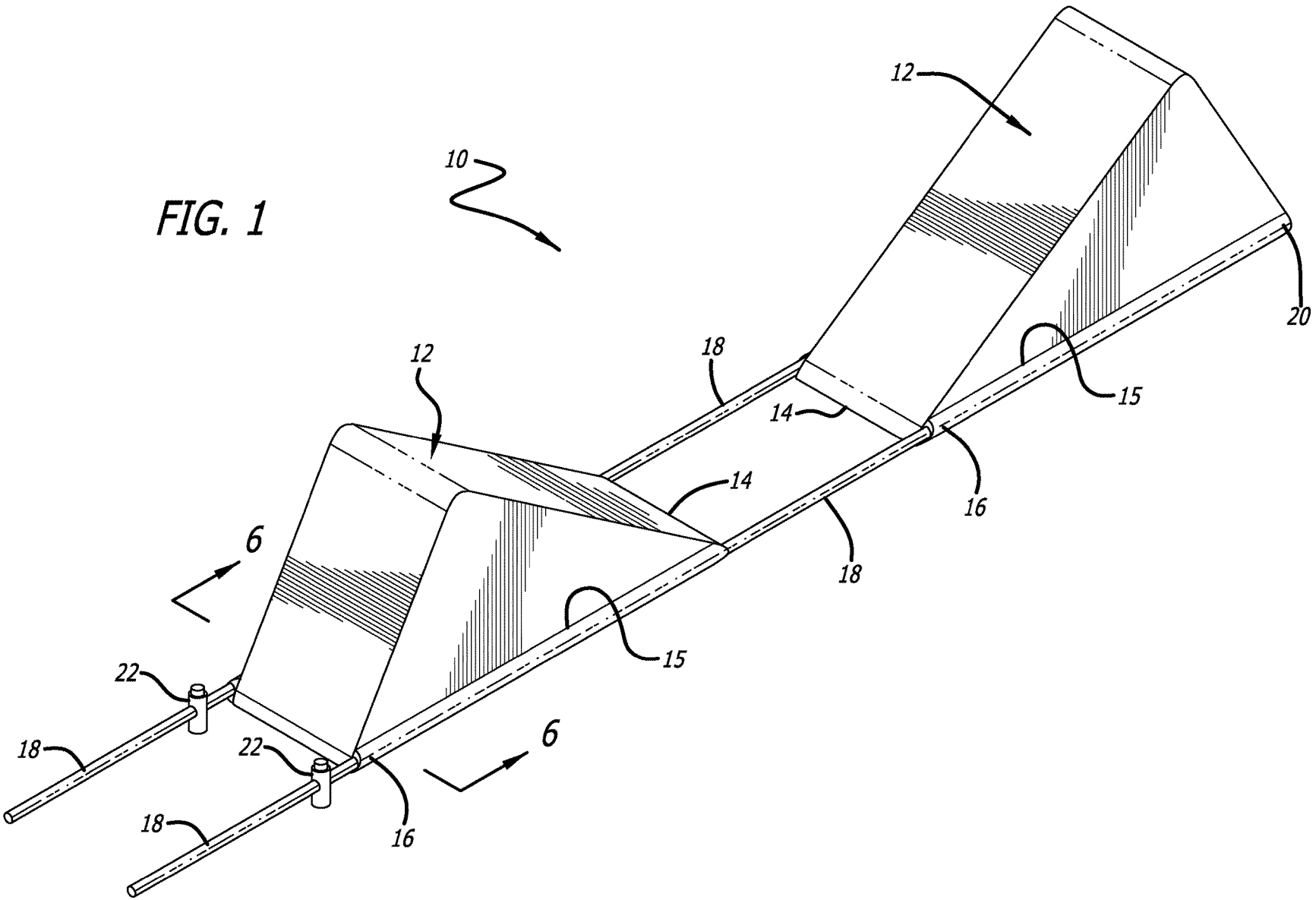
FIG. 1 is a perspective view of a first embodiment of the present invention shown as a pillow.
Figure 2:
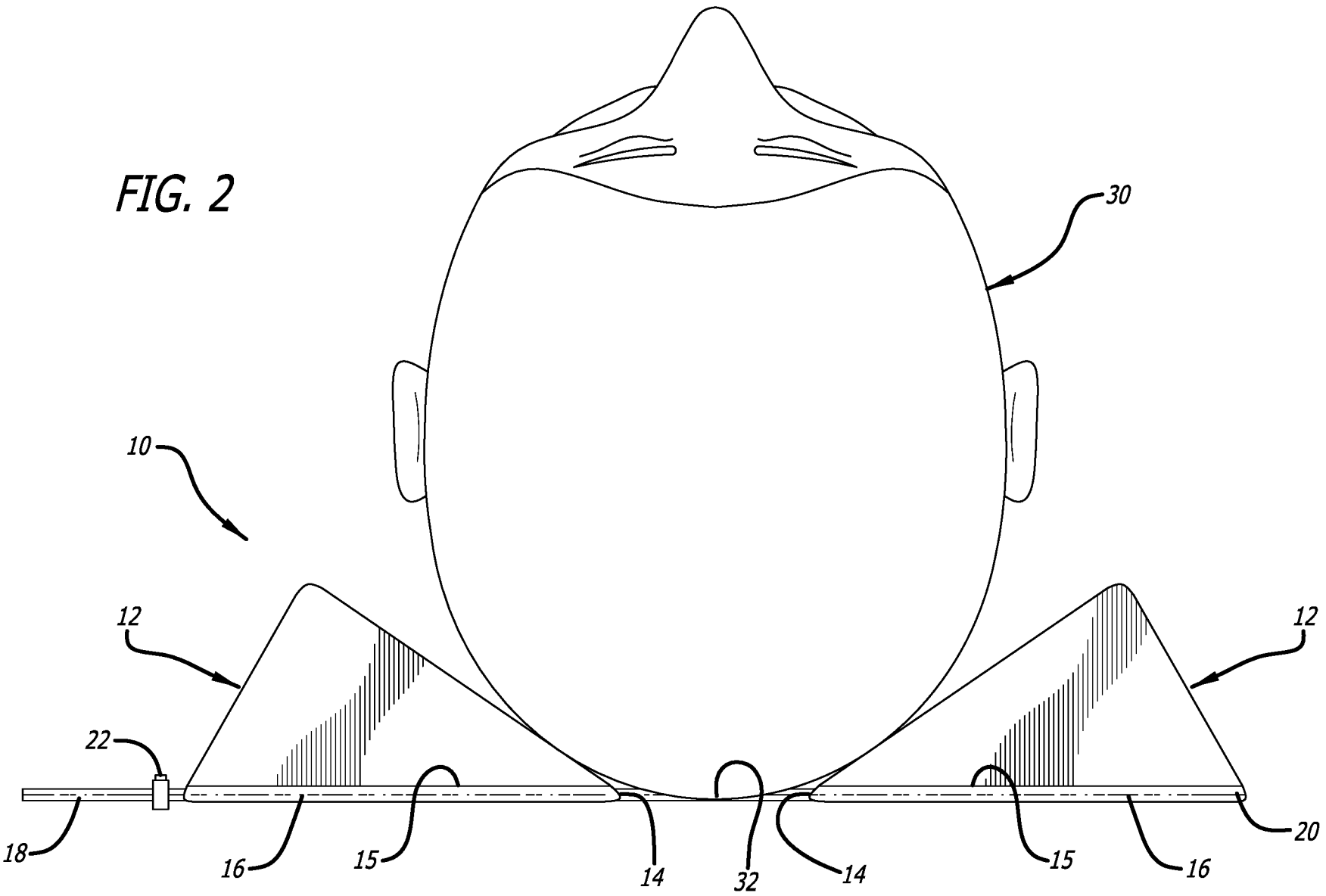
FIG. 2 depicts a view of a user's head positioned on the pillow illustrated in FIG. 1.
Figure 3:
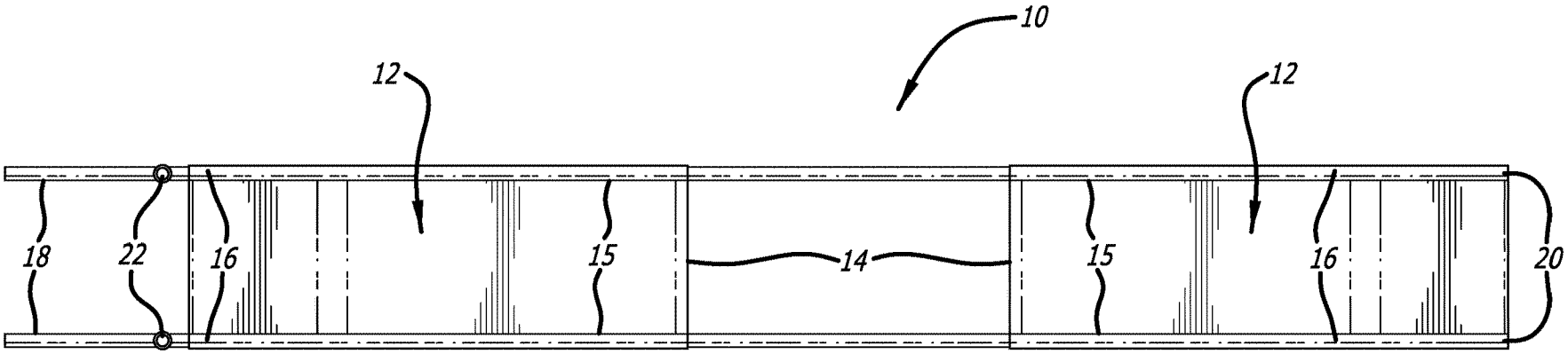
FIG. 3 is a top view of the pillow depicted in the prior figures in an open position.
Figure 4:
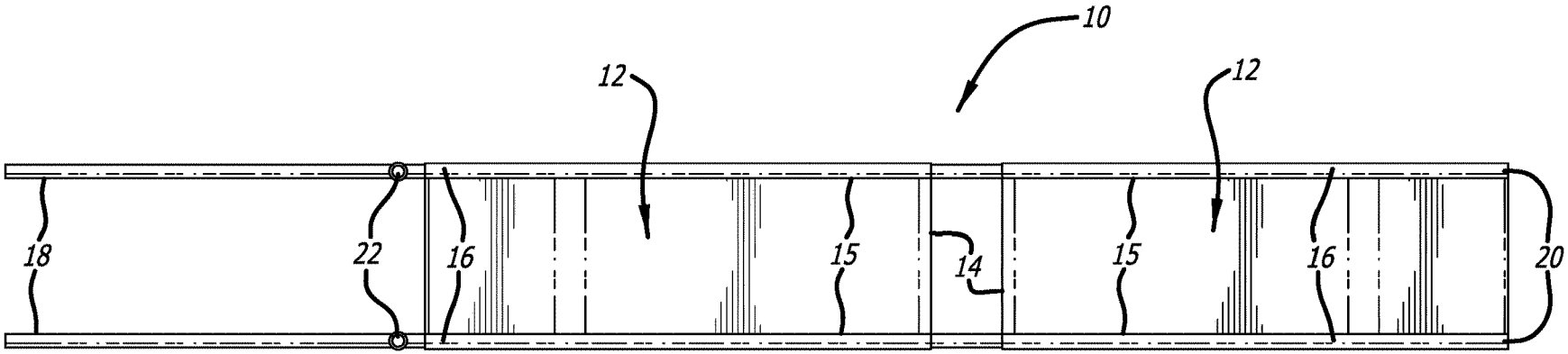
FIG. 4 depicts a top view of the pillow depicted in the prior figures in a more closed position than shown in FIG. 3.
Figure 5:
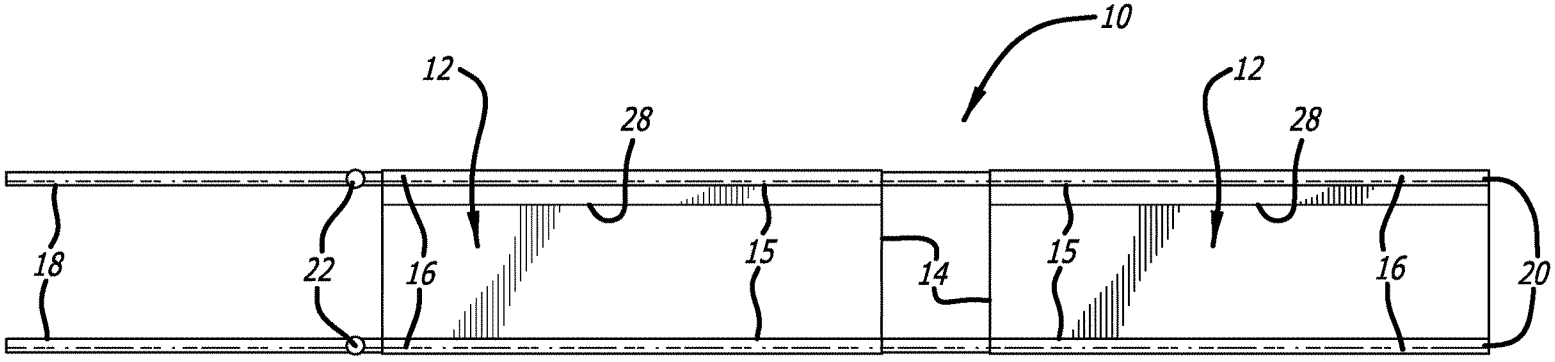
FIG. 5 is a bottom view of the present invention as illustrated in the prior figures.

As illustrated in FIGS. 1-6, the present invention as embodied as a pillow attachment mechanism 10 comprises first and second triangular pillows 12 having first and second ends 14 facing one another, first and second sides 15 generally positioned 90 degrees with respect to ends 14, and sleeves 16 which have tunneled configurations and which are secured to sides 15. A pair of first and second cords 18 are inserted within sleeves 16 and extend between and therefrom to enable a variable space to exist between facing ends 14 of pillows 12. Cords 18, e.g., also preferably comprising a micro-fiber, are secured by stitching or any other convenient method to one of the pillow s at fixed ends 20 of the side 12 as appearing at the right side of FIG. 1. At the other pillow 12 as shown at the left side of FIG. 1, a fastener such as a toggle 22 is employed to function to be secured to its cord 18 and, therefore, to limit the space between pillow ends 14.

Figure 6:
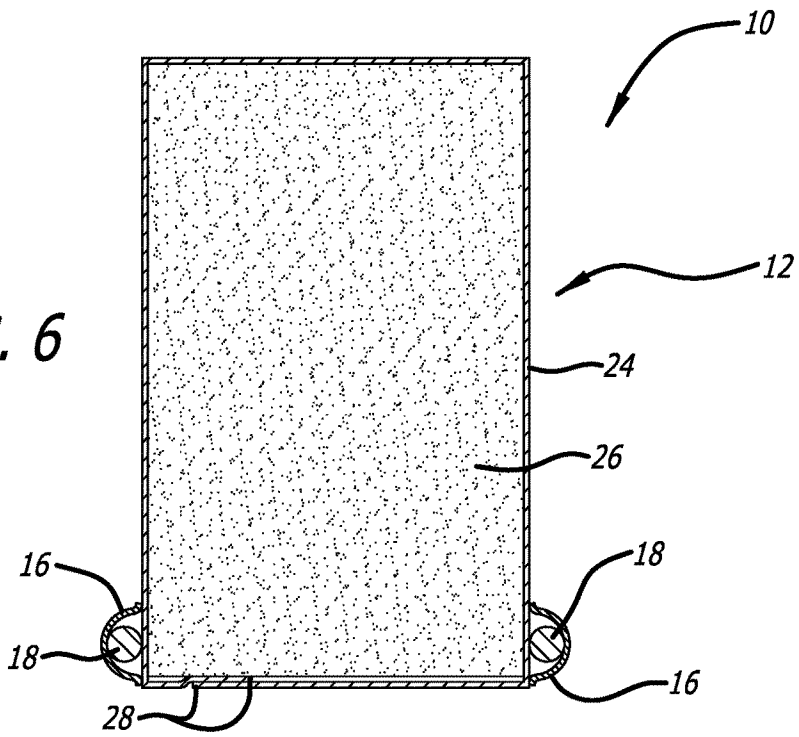
FIG. 6 is a cross-sectional view of the present invention taken along lines 6-6 of FIG. 1.
Figure 7:
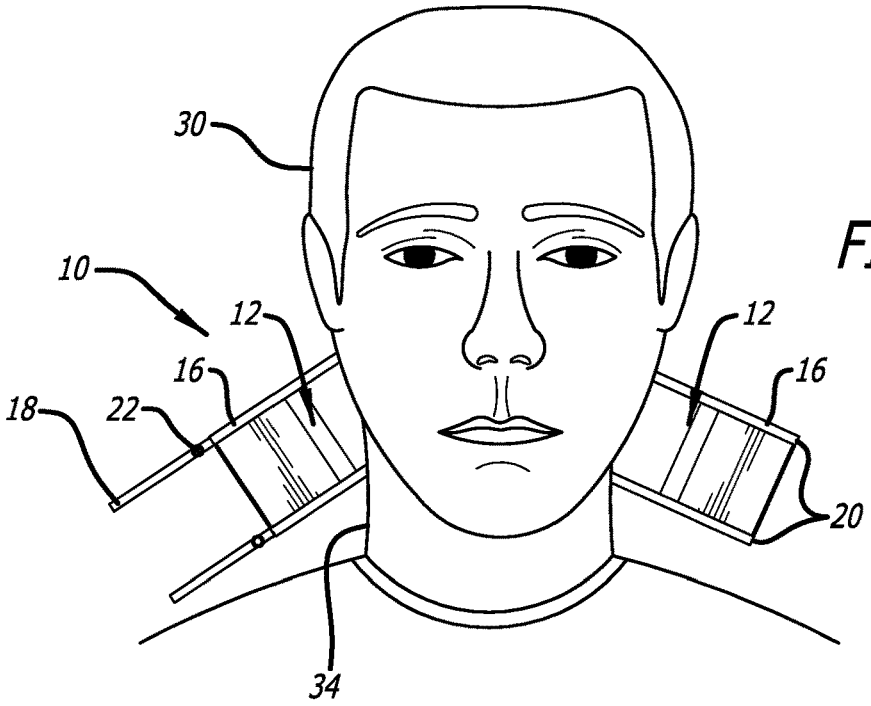
FIGS. 7 and 8 depict the pillows supporting the user at the back of the user's neck.
Figure 8:
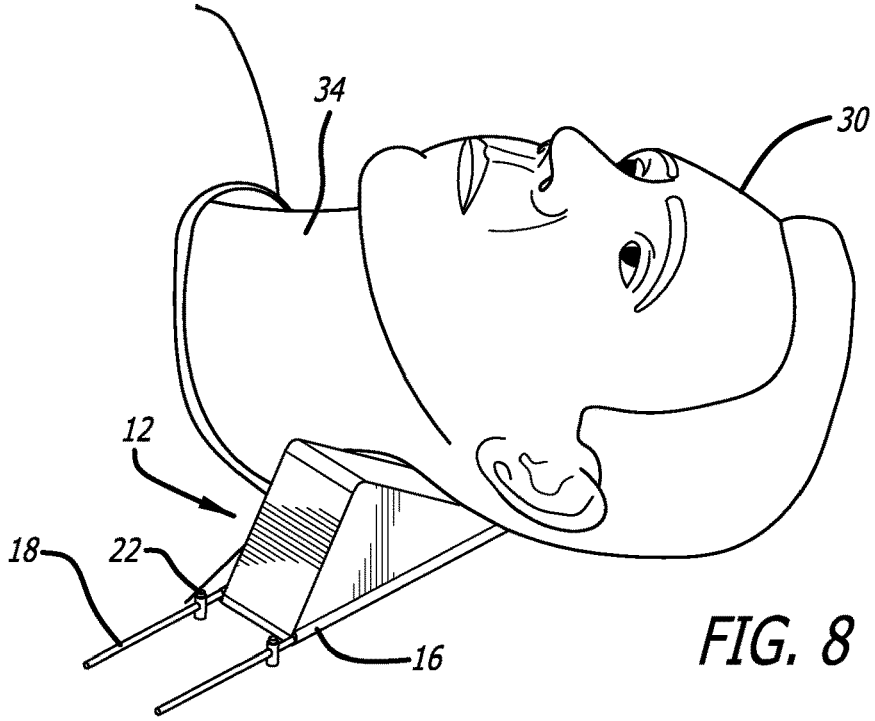
Figure 13:
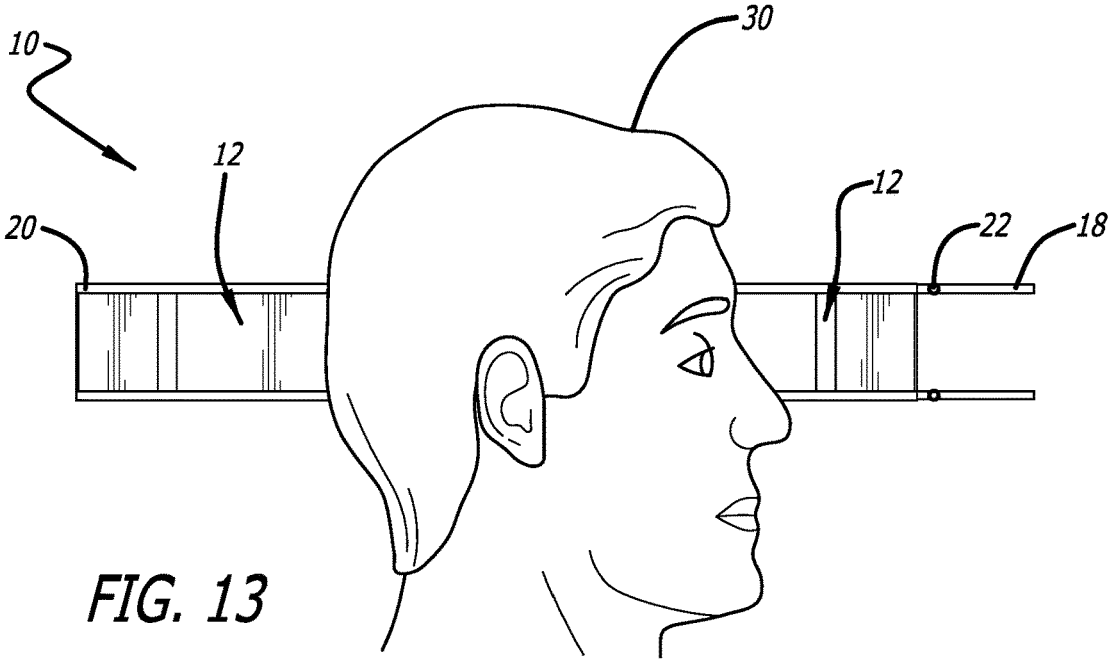
Figure 14:
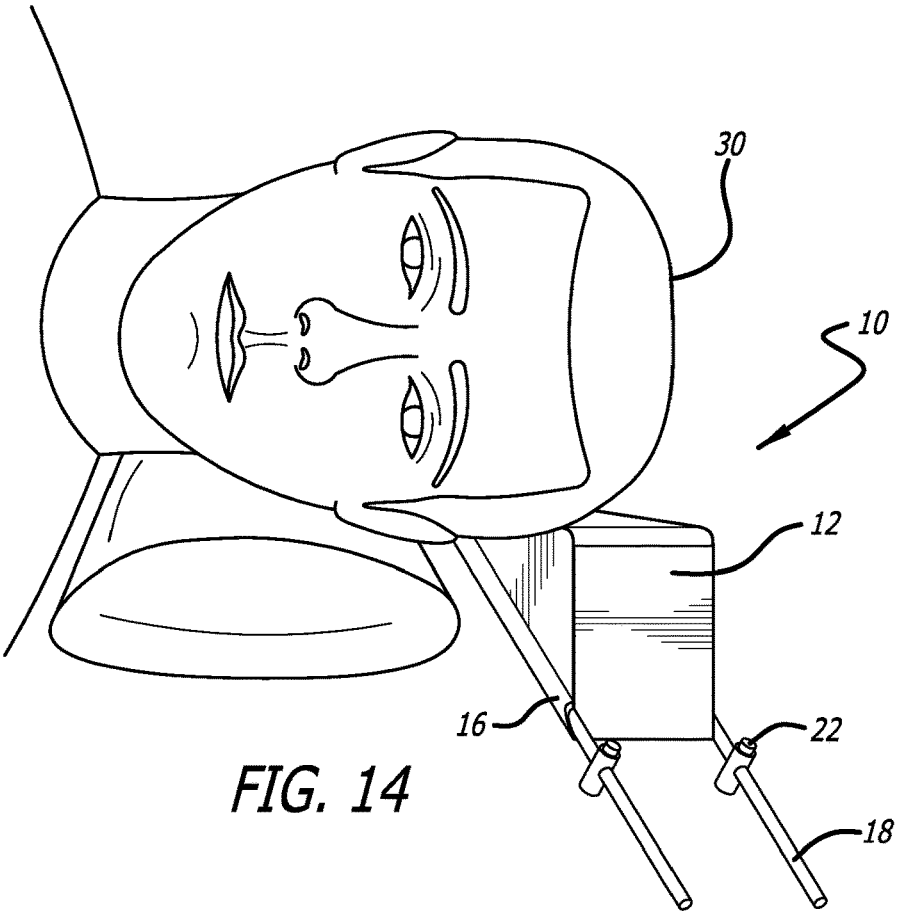

As best depicted in FIG. 6, each pillow 12 comprises a cover 24 inclosing a foam insert 26. The pillow cover may comprise any suitable material, here as shown as being shown as a cloth, such as comprising a micro-fiber fabric, having overlapping ends 28 which can be opened to enable insertion and removal of the foam insert.

As described earlier and now also shown in FIG. 2, the space between facing ends 14 is determined by the dimension of a user's head 30, as here illustrated, and the user's need (e.g., surgical or post-surgical). Accordingly, the user's head 30 is shown to rest between pillows 12, with the spacing being fixed by use of toggles 22. As stated in the summary of the invention, the device's use is just as much for use in surgical procedures as for post-surgery care sleep comfort.

Reference is now made to FIGS. 7-14 which illustrate the use of the first embodiment employing cords 18 and toggles 22, depending on whether support is needed for the user's neck (FIGS. 7 and 8), back of the head (FIGS. 9 and 10) or side of the head (FIGS. 11 and 12).

The second embodiment in FIGS. 15 and 16 illustrate a single strap 118 enclosed within sleeves 116 which are placed at the bottom surfaces of pillows 112, which pillows are separated by their facing ends 114. Single strap 118, rather than cords 18 as previously described and shown, acts in a similar manner and, likewise, is secured (as identified by numeral 120) to the pillow as shown in the right side of FIG. 15. A stopper 122 is placed at the end of the strap to ensure that pillow 112, as depicted in the left-hand side of FIG. 15, is retained not to slip from within that sleeve 116 of that left-hand pillow of FIG. 15.

Although the invention has been described with respect to particular embodiments thereof, it should be realized that various changes and modifications may be made therein without departing from the spirit and scope of the invention.

What is claimed is:

1. A pillow attachment mechanism for positioning of the head and neck, said pillow attachment mechanism comprising:

a first pillow and second pillow, each of said first pillow and said second pillow having a triangular configuration, wherein each of said first pillow and said second pillow comprises a first end and second end at a bottom side of said triangular configuration, wherein said first ends of said first pillow and said second pillow face each other, and said second ends of said first pillow and said second pillow position at opposite ends of said first ends of said triangular configuration of said first pillow and said second pillow, respectively;

sleeves provided at the bottom side of said first pillow and said second pillow, wherein said sleeves position at distal edges of the bottom side of said first pillow and said second pillow, and wherein said sleeves comprise a tunneled configuration;

first cord and second cord inserted into said sleeves of said first pillow and said second pillow from said first end to said second end and extending therefrom; and fasteners secured to said first cord and said second cord, wherein said fasteners face said second ends of said first pillow and said second pillow, respectively, wherein the entirety of the first cord and the second cord are level with said first pillow and said second pillow when lying on a flat surface;

wherein said first pillow and said second pillow extend along said first cord and said cord and come in contact with said fasteners creating a space between said first ends of said first pillow and said second pillow for positioning a head of a user, and wherein said fasteners restrict the movement of said first pillow and said second pillow along said first cord and said second cord.

2. The pillow attachment mechanism of claim 1, wherein each of said first pillow and said second pillow comprises a cover having a foam interior, and wherein said cover comprises a slit for enabling insertion and removal of said cover from said first pillow and said second pillow.

3. The pillow attachment mechanism of claim 1, wherein said fasteners comprise toggles.

4. A pillow attachment mechanism for positioning of the head and neck, said pillow attachment mechanism comprising:

a first pillow and second pillow, each of said first pillow and said second pillow having a triangular configuration, wherein each of said first pillow and said second pillow comprises a first end and second end at a bottom side of said triangular configuration, wherein said first ends of said first pillow and said second pillow face each other, and said second ends of said first pillow and said second pillow position at opposite ends of said first ends of said triangular configuration of said first pillow and said second pillow, respectively;

a sleeve secured provided at the bottom side of each of said first pillow and said second pillow, and wherein said sleeve comprises a tunneled configuration;

a strap inserted into said sleeve of each of said first pillow and said second pillow and extending therefrom; and a fastener secured to said strap at said second end of said second pillow, wherein the entirety of the strap is level with said first pillow and said second pillow when lying on a flat surface;

wherein said second pillow extends along said strap and comes in contact with said fasteners creating a space between said first ends of said first pillow and said second pillow for positioning a head of a user, and wherein said fastener restricts the movement of said second pillow along said strap.

5. The pillow attachment mechanism of claim 4, wherein each of said first pillow and said second pillow comprises a cover having a foam interior, and wherein said cover comprises a slit for enabling insertion and removal of said cover from said first pillow and said second pillow.

6. The pillow attachment mechanism of claim 4, wherein adjacent sides of the bottom sides of said triangular configuration facing said first ends of said first pillow and said second pillow position at substantial 90 degrees.

7. The pillow attachment mechanism of claim 4, wherein said strap is in the form of a loop.

8. The pillow attachment mechanism of claim 4, wherein said strap comprises another fastener at said second end of said first pillow, and wherein said fasteners restrict the movement of said first pillow and said second pillow along said strap when come in contact with said first pillow and said second pillow creating the space between said first ends of said first pillow and said second pillow for positioning the head of the user.

* * * * *